US006672673B1

(12) United States Patent
Miller et al.

(10) Patent No.: US 6,672,673 B1
(45) Date of Patent: Jan. 6, 2004

(54) ORE PASS INSPECTION SYSTEM

(75) Inventors: Arthur L. Miller, Spokane, WA (US); Christopher Dorrington, Helena, MT (US); Paula Schmitz, Edgewood, WA (US); Travis Garvey, Beaverton, OR (US); Peter Maricich, Renton, WA (US)

(73) Assignee: The United States of America as represented by the Department of Health and Human Services, Washington, DC (US)

( * ) Notice: Subject to any disclaimer, the term of this patent is extended or adjusted under 35 U.S.C. 154(b) by 0 days.

(21) Appl. No.: 10/089,432

(22) PCT Filed: Aug. 4, 2000

(86) PCT No.: PCT/US00/21354

§ 371 (c)(1),
(2), (4) Date: Jun. 24, 2002

(87) PCT Pub. No.: WO01/23710

PCT Pub. Date: Apr. 5, 2001

Related U.S. Application Data

(60) Provisional application No. 60/156,661, filed on Sep. 29, 1999.

(51) Int. Cl.[7] ..... E21C 37/00

(52) U.S. Cl. ..... 299/10; 299/13; 299/69; 299/30; 299/95; 102/321

(58) Field of Search ..... 102/321, 371; 299/10, 12, 13, 69, 70, 30, 95; 405/148, 133

(56) References Cited

U.S. PATENT DOCUMENTS

| | | | | |
|---|---|---|---|---|
| 4,023,862 A | | 5/1977 | Gold | |
| 4,368,924 A | | 1/1983 | Nussbaumer | |
| 4,708,395 A | | 11/1987 | Petry et al. | |
| 4,930,595 A | | 6/1990 | Hayward et al. | |
| 4,986,374 A | | 1/1991 | Niemi et al. | |
| 5,069,108 A | | 12/1991 | Dion | |
| 5,233,926 A | * | 8/1993 | Carmichael et al. | 102/302 |

FOREIGN PATENT DOCUMENTS

EP 0 767 289 A 4/1990

* cited by examiner

*Primary Examiner*—Heather Shackelford
*Assistant Examiner*—John Kreck

(57) ABSTRACT

The present invention discloses an apparatus and method for imaging and clearing an ore pass hang-up. The apparatus includes: a platform that is movable along generally a longitudinal direction of an ore pass; a controllable propulsion unit capable of propelling the platform within the ore pass and to the location of the hang-up; an imaging unit capable of generating an image of the ore pass as the apparatus is moved trough the ore pass, wherein the image is transmittable to a remove viewer; extensible, remotely controllable immobilizing units affixed to the platform; and a remotely controllable unit for clearing the ore pass hang-up. Once in place the apparatus is used to break up or clear the hang-up by, for example, directing blows to the hang-up, directing high pressure fluids to the hang-up, and using an explosive charge.

39 Claims, 4 Drawing Sheets

ORE PASS INSPECTION SYSTEM

This is a §371 U.S. national stage of PCT/US00/21354, filed Aug. 4, 2000, which was published under PCT Article 21(2), and claims the benefit of U.S. application Ser. No. 60/156,661, filed Sep. 29, 1999.

FIELD OF THE INVENTION

This invention relates to an ore pass inspection system that allows imaging of the ore pass in an underground mine. This ore pass inspection system is especially useful in cases of hang-ups or blockages within the ore pass. This inspection system can also be used to help clear such hang-ups or blockages.

BACKGROUND OF THE INVENTION

An ore pass is a generally vertical or near-vertical passage excavated between at least two levels in an underground mine. The levels occur at different vertical displacements in the mine. The vertical distances between such levels, and thus the vertical extent of the ore pass, may range up to hundreds of feet or even more. Such ore passes provide a passageway for delivering mine products (i.e., ore, coal, and the like) from a higher level to a lower level within the mine. Generally, the lower level contains ore carts, carriages, trams, or other transport devices which allow the mine products to be removed directly or indirectly out of the mine. In some cases, the lower level can serve several higher levels through the same or different ore passes.

The interior walls of an ore pass may contain surface structures ranging from smooth to very rough. The surface features may depend, for example, on the geological structures traversed by the ore pass, the nature of the mining tool or apparatus used in boring out the ore pass, and similar factors. Additionally, the cross-sectional dimensions of such ore passes may vary. Likewise, the sizes, shapes, and structures of the mining products being transported via the ore pass may vary greatly. Thus, from time to time in a given ore pass, the mining products may "hang up" within the ore pass. The just mentioned factors contribute to the likelihood of such hang-ups and blockages within ore passes. The likelihood of such blockages will be significantly higher in some cases (e.g., rough ore pass surfaces, "bottlenecks" within the ore pass, non-vertical passageways within the ore pass, large and irregularly shaped mine products). Once a hang-up or blockage occurs, the piling up of additional mine product on top of the hang-up often packs the blockage more tightly and makes removal of the blockage more difficult.

Clearing an ore pass hang-up or blockage presents significant safety concerns. For example, a miner at the lower end of the ore pass attempting to remove the blockage could be exposed to any material dislodged from the hang-up. If the miner is standing at the bottom end of the ore pass, and directing a disrupting force upwards into the ore pass toward the hang-up, any sudden rush of ore attending a successful clearing operation may trap the miner and cause serious injury or death. As of the time of this invention, there have been at least five ore pass-related fatalities in the preceding five years in the United States, and a far larger number of ore pass hang-up-related injuries.

The United States has about 100 to 200 mines containing working ore passes. Any given mine may have one or more ore passes; some mines have upwards of 10 or even more ore passes. Depending on the factors identified above, the frequency and likelihood of an ore pass hang-up may vary considerably. In some case, an ore pass may become hung-up only rarely in other cases, it may be an almost daily occurrence. Likewise, and for similar reasons, the degree of difficulty in clearing such a hang-up varies widely. Numerous techniques to remove the blockage have been developed. These include, for example, delivering blows to structures adjoining or related to the ore pass; placing a small blasting charge either just inside the ore pass or as close to the blockage as possible using, for example, a long pole; or propelling the explosive charge as a ballistic slug toward the location of the hang-up. Alternatively, a separate long hole may be drilled from below (mobilizing a drill rig in the passageway beneath the blockage) in order to deliver a blasting agent through the drilled hole into the hang-up. Clearly, the latter tactic is both time consuming and expensive. In some cases, the mine operator may choose to abandon the blocked ore pass and bore a new one.

U.S. Pat. No. 4,930,595 discloses a method of remotely determining the profile of a subterranean passage within a mine using an instrument pod that can be moved along the passage. The pod includes a rangefinder for determining the distances from a defined longitudinal axis of the pod to multiple points on the internal wall of the passage and providing an output signal representing the profile of the passage. A clinometer is used to indicate the orientation of the pod in the passage. The signals are transmitted to a remote location and provide a visual representation of the profile of the passage at a given location. As the pod is moved, successive representations at different locations are obtained. The pod is preferably also provided with a television camera and lighting so that the wall of the passage can also be visually inspected. Since the pod moves by gravity, it is generally intended for use by being lowered down the passage; in some cases, the pod can be pulled up the passage.

U.S. Pat. No. 4,023,862 provides a coal mining method wherein the coal seam is disintegrated by utilizing a jet of hot oil under pressure. Since an operation can be remotely controlled in a deep mine shaft, exposure of mine workers can be minimized. The method further reduces the amount of coal dust produced and, thus, reduces the risk of dust explosions. A TV camera can be mounted on the mining machine for transmitting a picture of the operation to the surface so that appropriate guiding signals can be transmitted to the machine.

U.S. Pat. No. 4,708,395 discloses a method and apparatus for hydraulically mining a coal seam using a monitor and a hydraulic jet powered by high pressure water. The monitor includes means for remotely positioning the jet vertically and horizontally so that the jet can be aimed at any location within the zone of a mine face being mined. This system is especially useful in hazardous locations within a mine (e.g., unstable areas where the risk of roof falls is significant).

U.S. Pat. No. 5,069,108 discloses a blasting device for unblocking ore passes, backfill raises, mine draw points, or other near vertical raises where rocks or other materials normally fall freely but may get blocked during use. The device includes a propulsion unit including an air chamber mounted at the end of a hollow tube with an inlet for receiving pressurized air and at least one outlet for allowing compressed air jets to exit downwardly from the air chamber to propel the propulsion unit upwardly. A reservoir is mounted on the propulsion unit and adapted to hold an explosive charge and an igniter which can be remotely activated.

As those skilled in the art realize, it is generally more effective to attack a blockage from below. But efforts from below place the workers at maximum risk since once the blockage is clear, the hung-up materials will, of course, continue their fall through the ore pass. Even if the blockage is not completely cleared, material dislodged from the blockage place workers located below at significant risk.

Thus, there still remains a need for an apparatus and method that integrally permits placing the apparatus in a location immediately under a hang-up in an ore pass in order to clear the hang-up while minimizing the risks to the operator. There additionally remains a need for an apparatus and method that substantially eliminates guesswork in placing a device to clear an ore pass hang-up, and that employs an image based guiding mechanism to direct the apparatus to a preferred position for clearing a hang-up. There further remains needs for method for clearing blockages and for an apparatus and that is reusable. The present invention addresses these unresolved needs.

SUMMARY OF THE INVENTION

The present invention discloses an apparatus for clearing a material hang-up in an essentially vertical shaft having walls which is used for moving material from a higher level to a lower level, said apparatus comprising:

(1) a platform having an upper surface and a lower surface and at least two ends, wherein the platform is movable along a longitudinal direction within the shaft;

(2) a remotely controllable propulsion unit affixed to the lower surface of the platform capable of propelling the platform along the longitudinal direction within the shaft and up to the hang-up;

(3) an imaging unit affixed to the upper surface of the platform capable of generating an image of an upward view within the shaft, wherein the image is transmittable to a remote viewer, and wherein the image can be viewed by an operator to assist in controlling and operating the apparatus;

(4) one or more extensible immobilizing units affixed to the ends of the platform, wherein the immobilizing units are remotely controllable, and wherein the immobilizing units, when activated by the operator, immobilize the platform within the shaft;

(5) a remotely controllable clearing unit affixed to the platform and adapted for clearing the hang-up within the shaft; and (6) a remote controller for controlling the propulsion unit, the immobilizing units, and the clearing unit;

wherein the apparatus can be controlled and operated by the operator using the remote controller at a safe distance from the shaft. This apparatus is especially adapted for use in ore passes in underground mines. Preferably, the immobilizing unit allows the operator to immobilize the apparatus at a fixed longitudinal position within the ore pass by providing members that can contact the walls of the ore pass in a manner to immobilize the platform in the desired position (i.e., generally a position from which the hang-up can be cleared). Preferably the apparatus has a light source to provide light for the imaging unit; preferably, both the light source and the imaging unit can be remotely controlled. If desired, the imaging unit may incorporate a zoom-type lens.

In a significant embodiment of the apparatus, the propulsion unit comprises a gas receiving chamber, a source of a gas under high pressure in communication with the chamber, and at least one gas nozzle affixed to the chamber and projecting downward therefrom. Preferably, the gas source is located at a remote, and protected, position relative to the platform (e.g., at a safe location near the bottom of the ore pass). In a further significant embodiment, the imaging unit includes a light source directing light generally upward along the ore pass above the platform and an imaging device capable of generating the image. When the apparatus is positioned just below the ore pass hang-up, the image allows the operator to view the blockage and place the platform in position to remove or breakup the blockage.

In an important embodiment of the apparatus, the extensible immobilizing unit includes at least one balloon or bladder inflatable by gas under pressure, and a first remotely controllable valve capable of controllably admitting the pressurized gas into the balloon(s) or bladder(s). Furthermore, in an alternative important embodiment, the extensible immobilizing unit includes at least one prong or leg extendably engaged to a remotely controllable driving unit capable of controllably extending the prong. In operation, the balloon(s) and/or prong(s) are activated so as to extend out from the platform and contact the walls of the ore pass. The activated balloon(s) and/or prong(s) effectively lock the platform in place by applying pressure through the balloon(s) and/or prong(s) or leg(s). In another important embodiment of the apparatus, the extensible immobilizing unit or units can also be remotely retractable to allow the apparatus to be removed entirely or repositioned as desired. For example, the extensible immobilizing unit or units include one or more balloons, the retractable mobilizing unit or units would include a second remotely controllable valve for controllably releasing gas from the one or more balloons. Where the extensible immobilizing unit includes one or more prongs or legs, the retractable mobilizing unit would allow retraction of the prongs or legs. Of course, the extensible immobilizing unit can be modified to allow both activation (i.e., extension) and deactivation (i.e., retraction).

In an advantageous embodiment of the apparatus, the unit for clearing ore pass hang-ups includes a device to deliver high-impact blows to the blockage in general or to a particular location in the hang-up (e.g., to "key" pieces of material in the hang-up that appear to be responsible for the hang-up). In an alternative advantageous embodiment, the unit for clearing the ore pass hang-up includes a stream of a fluid under high pressure to breakup the hang-up.

Where these methods of breaking up the hang-up fail, the platform can be equipped with a remotely controlled explosive material or charge. In such cases, the apparatus preferably allows the explosive charge to be affixed or attached to blockage so that the apparatus itself can be removed from the ore pass before the charge is remotely activated. Of course, if desired, explosive charges could be used without first attempting to use other methods. Thus, in another significant embodiment of this invention, the unit for clearing the ore pass hang-up includes an emplacement unit and an explosive charge, wherein the emplacement unit includes: (1) a remotely controllable drive unit; and (2) a holder having a proximal end and a distal end, wherein the proximal end is pivotally and swivelably affixed to the drive unit; wherein the distal end is releasably holding the explosive charge; wherein the drive unit is capable of causing the holder to be moved in order to move the explosive charge to the desired location; and wherein the explosive charge further includes (a) a detonation device and (b) an attachment element whereby the explosive charge can be attached to the desired location on the hang-up. Preferably the detonation device allows the explosive charge to be triggered remotely. Suitable attachment elements include, for example, adhesives, grappling hooks or devices, and the like. Additionally, the explosive charge can be of the plastic type which can simply be "packed" within voids or crevices within the hang-up. Preferably, the platform is removed before the explosive charge is triggered. In some especially difficult hang-ups, a second platform (but without the imaging equipment) can be locked into place just below the explosive charge and the hang-up so as to direct the force of the charge up into the hang-up.

The invention furthermore provides a method for imaging and clearing a shaft or ore pass containing a hang-up using the above-discussed systems and apparatuses. More specifically, this method comprises:

(1) introducing an apparatus for clearing the hang-up into the lower end of the shaft blocked by the hang-up, wherein the apparatus is capable of:
  (a) being remotely propelled within the shaft so that the apparatus can be positioned adjacent to and below the hang-up by an operator located at a safe distance from the lower end of the shaft;
  (b) providing an image of an upward view of the shaft as the apparatus is propelled within the shaft and is positioned adjacent to and below the hang-up, where the image is transmitted to the operator,
  (c) being remotely immobilized in a position adjacent to and below the hang-up by the operator, and
  (d) remotely clearing the hang-up after being immobilized in a position adjacent to and below the hang-up;
(2) remotely propelling the apparatus upward within the shaft until the apparatus is positioned adjacent to and below the hang-up, wherein the image is used by the operator to guide the apparatus within the shaft;
(3) remotely immobilizing the apparatus adjacent to and below the hang-up; and
(4) remotely clearing the hang-up.

DETAILED DESCRIPTION OF THE INVENTION

Figure 1A:
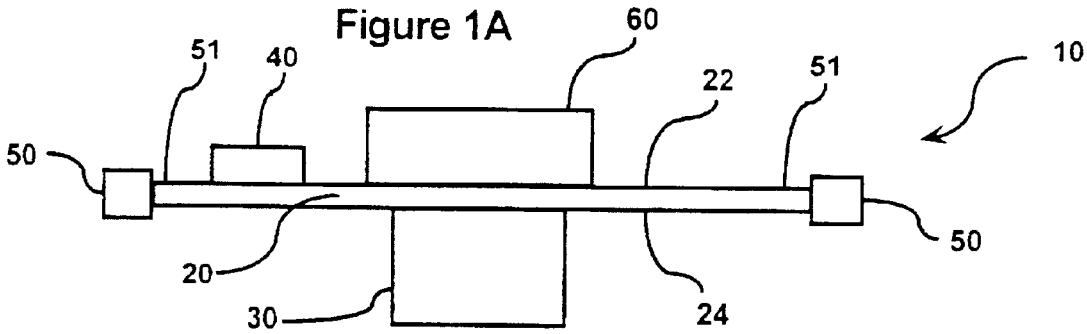
FIG. 1A provides a schematic diagram (side view) of the apparatus for imaging and clearing an ore pass hang-up.

This invention relates to a shaft inspection system (including apparatus and methods) for inspection and clearing of hang-ups. More particularly, this invention relates to an ore pass inspection system (including apparatus and methods) that allows imaging of the ore pass in an underground mine. This ore pass inspection system is especially useful in cases of hang-ups or blockages within the ore pass. This inspection system can also be used to help clear such hang-ups or blockages. As used herein, an "ore pass" relates generally to an essentially vertical (i.e., vertical or near-vertical) shaft, chute, raise, winze, or similar passage bored between at least two levels in an underground mine wherein the ore or other mined material can be moved from an upper level to a lower level using gravity. As used herein, a "shaft" relates generally to an essentially vertical (i.e., vertical or near-vertical) ore pass, chute, raise, winze, or similar passage spanning at least two levels wherein a solid material can be moved from an upper level to a lower level using gravity. As used herein, "ore" relates generally to any mine product developed during the course of mining operations. For example, ore may be rock or other mined material which has sufficient mineral or other value to justify extraction and recovery. Ore may also be the intended material for which a mine is established and which the mine produces for market. Additionally, as used herein, ore may be by-product tailings or similar waste produced in a mining operation that results, for example, when it is necessary to pass from one mineral-bearing vein to another, or it may be otherwise produced as required in a mining operation. Ore furthermore encompasses materials bearing elemental mine products with value, such as rocks bearing diamonds or rocks bearing elemental gold. Still further ore, as used herein, encompasses coal and similar non-mineral mining products. As used herein, "material" includes any solid, particulate material, including ore, that is moved from a higher level to a lower level using the force of gravity. As used herein, the "longitudinal direction" of an ore pass or shaft is considered to be the long axis of the ore pass or shaft.

The apparatus and the methods of the present invention provide for imaging and clearing an ore pass hang-up. As shown schematically in FIG. 1A (side elevation view), the apparatus 10 includes a platform or framework 20 having an upper surface 22 (i.e., on the surface adjacent to the hang-up) and a lower surface 24 (i.e., on the surface opposite to the hang-up), and at least two ends or sides 51 for mounting the extensible immobilizing units 50. The platform may having various shapes (i.e., triangular, square, rectangular, oval, circular, and the like). A rectangular platform 20 is shown in FIG. 1B. Such a rectangular platform 20 would have at least two ends 51 and at least two extensible immobilizing units 50; other shaped platforms 20 would have a plurality of ends 51 adapted for their specific shapes. Thus, the triangular platform 20 shown in FIG. 1C has three ends 51 (i.e., one on each side of the triangle) and, preferably, a corresponding number of extensible immobilizing units 50; the imaging unit 40 consists of a light source 142 and an imaging device 144. A circular platform 20 (see FIG. 1D) could have a plurality of ends 51 (preferably at least three) located around its circumference; thus, for a circular platform 20, the ends 51 are considered to be arbitrary locations or positions around the circumference such that, when activated, the immobilizing units 50 can lock the platform in place within the ore pass. The circular platform 20 shown in FIG. 1D has four immobilizing units 50. The apparatus, especially its footprint, is small enough that it can move freely along generally a longitudinal direction of an ore pass, but it is large enough that it may be readily immobilized as described below. Thus, the size of the platform 20 will generally be determined by the smallest cross-sectional dimension of the ore pass. Generally, a rectangular platform 20, for example, will often have dimensions in the range of about 12 to about 48 inches wide and about 18 to about 48 inches long. Generally, for a circular platform 20, the diameter will generally be about 12 to about 48 inches. As those skilled in the art will realize, platforms smaller or larger than the general dimensions just given and platforms of different shapes may be used and may, depending on the three-dimensional geometry of the particular ore pass, be preferred.

The apparatus includes a guidable or controllable propulsion unit shown schematically at 30 affixed to the lower surface 24 of the platform 20. The propulsion unit 30 should be capable of propelling the platform 20 along the generally longitudinal direction of the ore pass (i.e., up into the ore pass) in order to reach the hang-up. In a preferred embodiment, the propulsion unit 30 achieves levitation using a high pressure gas. Thus, the high pressure gas is supplied to the propulsion unit 30 and allowed to escape through at least one thrusting nozzle directed downwards. This generates a lifting force such that the apparatus is generally propellable upwards along the longitudinal direction of, and into, the ore pass and in the direction of the ore pass hang-up. In such a preferred embodiment, shown schematically in FIG. 2, a source of high pressure gas (not shown) is supplied using a high pressure gas line 132. The source of gas can be any conventional gas supply such as, for example, a compressor, compressed gas tanks, and the like. The high pressure gas line 132 is in communication with a receiving chamber 130 that receives the pressurized gas from the source. The gas is controllably released to atmospheric pressure through at least one gas nozzle 134 affixed to the receiving chamber and projecting downward therefrom. The preferred gas is air.

Figure 2:
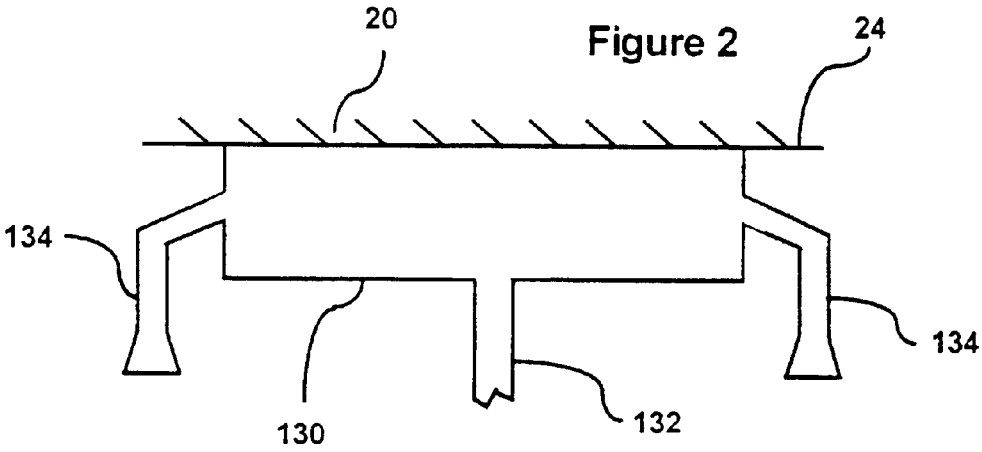
FIG. 2. A diagram of a guidable or controllable propulsion unit of the present invention based on expulsion of a gas under high pressure through gas nozzles.

Two nozzles 134 are shown in FIG. 2; as those skilled in the art will realize, only one or more than two such nozzles can be used. Preferably, at least three nozzles, arranged in a symmetrical pattern around the platform, are used to achieve more stable flight within the ore pass. More preferably three nozzles are used. The expanding gas provides the thrust to propel the apparatus upwards along the ore pass. Preferably the nozzles incorporate supersonic or converging-diverging type designs in order to maximize thrust. In alternative embodiments, the propulsion unit 30 may include solid or liquid chemical propellants such as may be used in rockets. It may further be a motor driven propeller or similar equivalent systems of propelling the apparatus in a controllable fashion along the longitudinal direction of the ore pass The propulsion unit 30 can provide the levitating effect required to controllably position, reposition, and/or remove (i.e., back out) the assembly.

Normally, the high pressure gas line 132 will extend from the platform, down the shaft or ore pass, and then to a remote gas source. If desired, other lines could be bundled with the high pressure gas line. These other lines could include electrical cables, hydraulic lines, optical fibers, liquid supply lines (i.e., to provide high pressure liquids for clearing the hang-up), and the like. Preferably, such lines are bundled (with or without the high pressure gas line) and protected with a protective cover.

Figure 3:
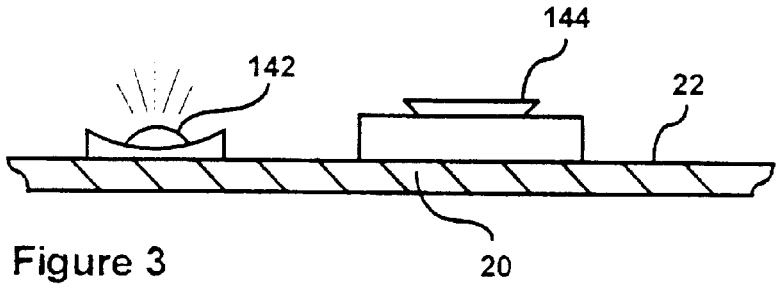
FIG. 3. A diagram of an imaging system used in the present invention.

Imaging units or systems, shown schematically at 40, are affixed to the upper surface 22 of the platform. The imaging unit is capable of generating an image of an upward view along the ore pass. In a preferred embodiment shown in FIG. 3, the imaging unit includes a light source light 142 directed upwards along the ore pass such that it illuminates generally the walls and lumen of the ore pass and the hang-up (including component pieces of ore comprising a hang-up) when the apparatus reaches the vicinity of such a hang-up. The light source may have fixed or variable intensity. The imaging unit 40 further includes an imaging device 144 such as, for example, an electronic video or TV camera (analog or digital) to provide an upwards field of view within the ore pass. If desired, the imaging device could have zooming capabilities. The image generated by the video camera is transmittable to a remote viewer such that an operator can view the image and use the information contained therein to guide the progress and operation of the apparatus. If desired, the light source and/or the imaging device can incorporate fiber optic technology. In cases where an open flame could be hazardous, the use of fiber optic technology for the light source may be preferred.

The apparatus also includes extensible immobilizing units shown schematically at 50 in FIGS. 1A and 1B affixed to the ends of the platform 20 which are used to effectively "lock" the platform in place within the ore pass at the appropriate location (generally just below the hang-up). If the platform is rectangular (as shown in FIG. 1B), the ends of each side arm will generally have its own immobilizing unit 50. For oval or circular platforms, a plurality (preferably about two to ten and more preferably about 2 to 5) of immobilizing units 50 are disposed in a regular or equidistant manner around the circumference. Alternatively, a circular platform 20 (or other shaped platforms) could have a single immobilizing unit attached around the entire outside surface of the platform. Thus, if desired, the circular platform 20 could be used with an inflatable bladder having an inner-tube or donut shape to engage the ore-pass walls. When extended or engaged, the immobilizing units are intended to engage the walls of the ore pass with sufficient force that the apparatus is immobilized at a fixed longitudinal position within the ore pass. Depending on the geometry of the cross section of the ore pass in which the apparatus is to be fixed, some or all of the immobilizing units 50 may be used. Extending the immobilizing units 50 furthermore is remotely controllable by an operator in response to the image transmitted by the imaging unit 40. The apparatus is intended to be so immobilized just below the lower extent or lower limit of the ore pass hang-up.

Figure 4:
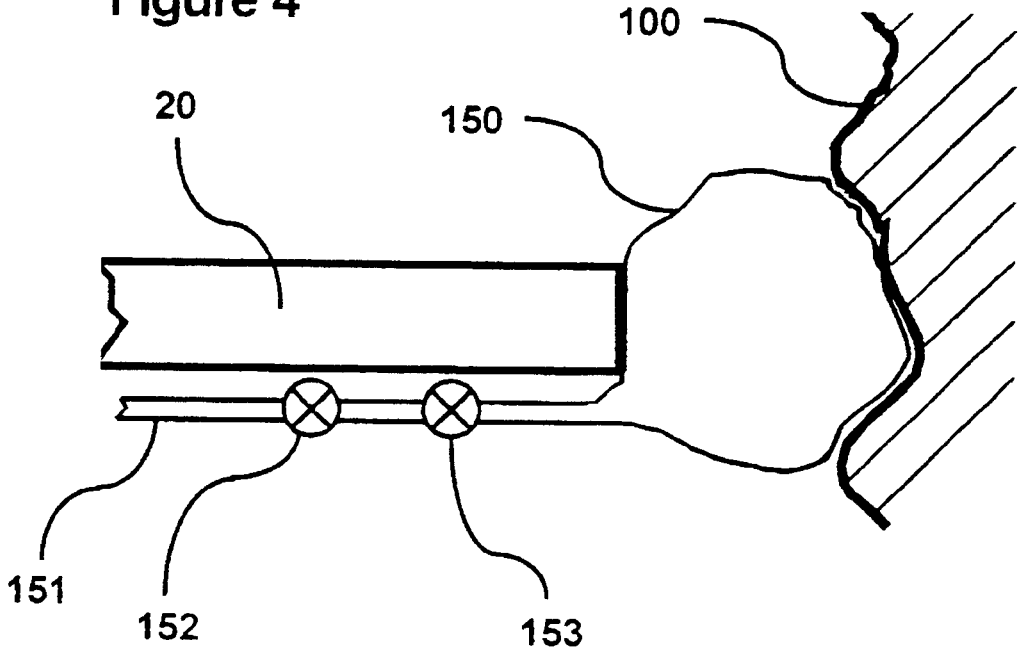
FIG. 4. A diagram of an embodiment of an immobilizing and remobilizing unit of the invention based on a balloon inflatable and deflatable using a set of controllable valves.

In a preferred embodiment shown in FIG. 4, the extensible immobilizing units comprise balloons or bladders 150 which can be inflated using gas under pressure. For example, the pressurized gas may be delivered from the gas receptacle 130 (FIG. 2) using a gas feed line 151; alternatively, a separate gas supply line (which could run along side of line 132) could be used if desired. The balloon or bladder 150 may be constructed of any gas impermeable, flexible material strong enough not to be torn or ruptured as the material engages the potentially rough surface of the ore pass. The flow of gas that inflates the balloon and causes it to engage the ore pass wall 100 is regulated by a first controllable valve 152 admitting the gas to the balloon.

Figure 5:
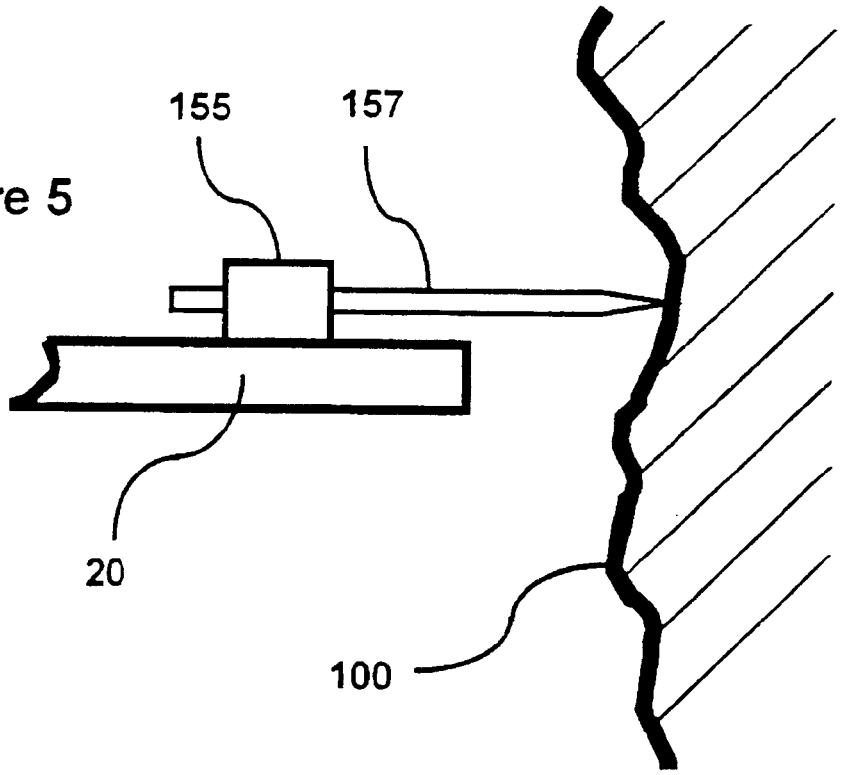
FIG. 5. A diagram of an embodiment of an immobilizing and remobilizing unit of the invention based on an extensible and retractable prong.

In an alternative preferred embodiment shown in FIG. 5, the extensible immobilizing units comprise at each end of the platform 20 a prong 157 which can be extended using a controllable driving unit 155 to contact the wall 100. Preferably, the platform will have a plurality of such prongs spaced around its circumference, more preferably, the platform will have about three to about five prongs. The driving unit 155 could, for example, comprise an electric motor, solenoid valves, gas driven valves, and the like. Once determined to be in the proper position, the operator activates the driving unit or units to extend prong 157 (and other prongs, not shown, which may be used) to contact and engage the wall 100 of the ore pass with sufficient force to immobilize the apparatus. Prongs 157 can, if desired, be formed of nested tubes or rods (similar to a retractable antenna) that can be extended and retracted as needed using, for example, air pressure, vacuum, and/or multi-stage pneumatic actuators.

Figure 1B:
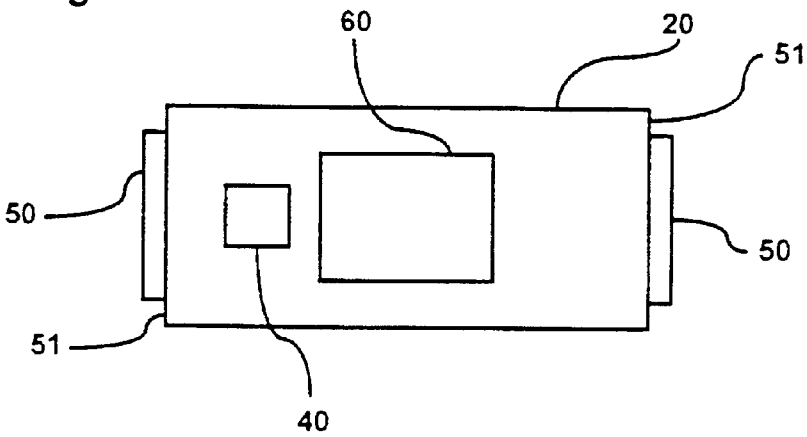
FIG. 1B provides a schematic diagram (viewed from above) of the apparatus from FIG. 1A having a rectangular platform.
Figure 1C:
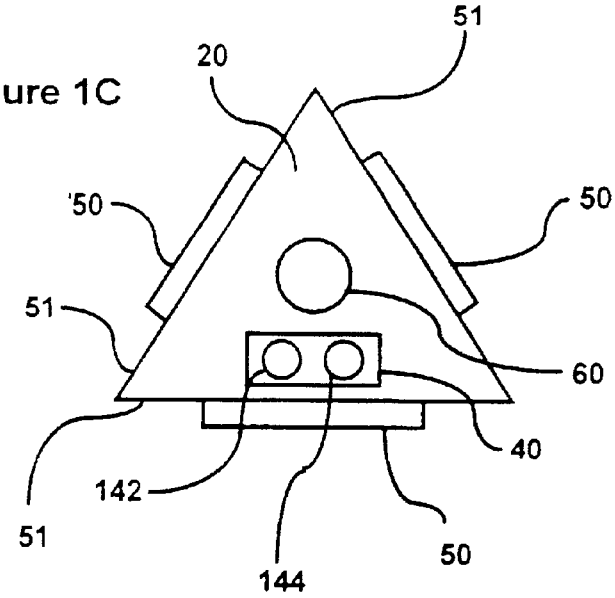
FIG. 1C provides a schematic diagram (viewed from above) of the apparatus having a triangular platform.
Figure 1D:
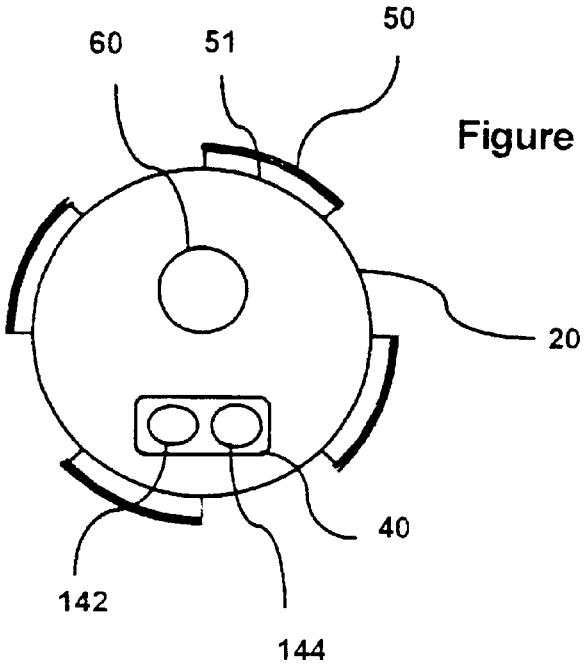
FIG. 1D provides a schematic diagram (viewed from above) of the apparatus having a circular platform.

The embodiments shown in FIGS. 1A, 1B. 1C, 1D, 4, and 5 have the extensible immobilizing units 50, 150, or 157 mounted externally on the platform 20; alternatively, such extensible immobilizing units could be mounted within the structure forming the platform. Indeed, in some cases, internal mounting of the extensible immobilizing units may be preferred since such a location would provide protection to the extensible immobilizing units as the assembly is raised or lowered within the ore pass.

The platform also has affixed to it a controllable unit or mechanism 60 to allow clearing of the ore pass hang-up. Once immobilized in the desired position within the ore pass (i.e., normally just below the hang-up), the operator activates the clearing mechanism to try to break up the hang-up and reestablish the flow of ore. In some cases, reestablishment of the flow of ore can damage or even destroy the apparatus. When damage to the apparatus is expected to be extensive, the apparatus will preferably be constructed of inexpensive materials and components. Alternatively, especially in cases where complete destruction is not expected, components susceptible to damage (e.g., imaging and light source units) may be retracted or otherwise covered and protected during the attempts to clear or break up the hang-up. Examples of clearing mechanisms that may be employed to break up the hang-up include high-impact blows directed towards the hang-up and high pressure fluid streams directed towards the hang-up.

Alternatively, clearing mechanisms can be used which allow the apparatus to be removed from the ore pass prior to activating the clearing operation. For example, the clearing mechanism (e.g., an explosive charge) may be attached directly to the hang-up and the apparatus simply removed before activation of the clearing mechanism. In such cases, the apparatus would be removed from the ore pass using essentially the same technique, except in the reverse direction used to initially guide the apparatus to the hang-up.

Alternatively, the immobilizing unit and the clearing mechanism could be adapted to controllably separate from the remainder of the apparatus. The remainder of the assembly (including the more expensive lighting, imaging, and propulsion units) could be removed while the immobilizing unit and clearing mechanism remain in place. Only after the remainder of the assembly is out of harm's way would the clearing operation begin. If desired, relatively inexpensive lighting and imaging units could be used which could remain within the ore pass to provide visual information regarding the clearing operation.

These additional operational features (i.e., removal of the assembly prior to the clearing operation) are accomplished in general by including retractable mobilizing units in addition to the extensible immobilizing units affixed to the ends of the platform. Retraction of the immobilizing units is also remotely controllable, and is carried out after placing clearing units on or near the hang-up. Retracting the immobilizing units serves to mobilize the apparatus for propulsion back down along the longitudinal direction of the ore pass.

Using inflatable balloons as the immobilizing unit, as shown in FIG. 4, a second controllable valve 153 can be used to depressurize or deflate the balloons so that the assembly can be removed. In such a case, balloon 150 is inflated by controlling the first valve 152 to open and admit gas to the balloon to lock the assembly in place. After the clearing unit is properly positioned, the second controllable valve 153 is activated to deflate the balloon. The first and second valves may be separate units or may be combined in a single valve system (e.g., a "Tee" valve). Such a valve could have, for example, a first operating position wherein the balloon inflates, a second operating position wherein gas cannot pass into or out of the balloon, and a third operating position wherein the balloon gas can exit to atmosphere and allow the balloon to deflate. Similar systems could, of course, be used to operate the prongs 157 shown in FIG. 5 (i.e., engage and disengaged the prongs as appropriate). Equivalent configurations of the first and second valves 152 and 153 can be used as long as they accomplish the same operational objectives (i.e., allow the immobilizing units to be controllably engaged and disengaged as desired).

Figure 6:
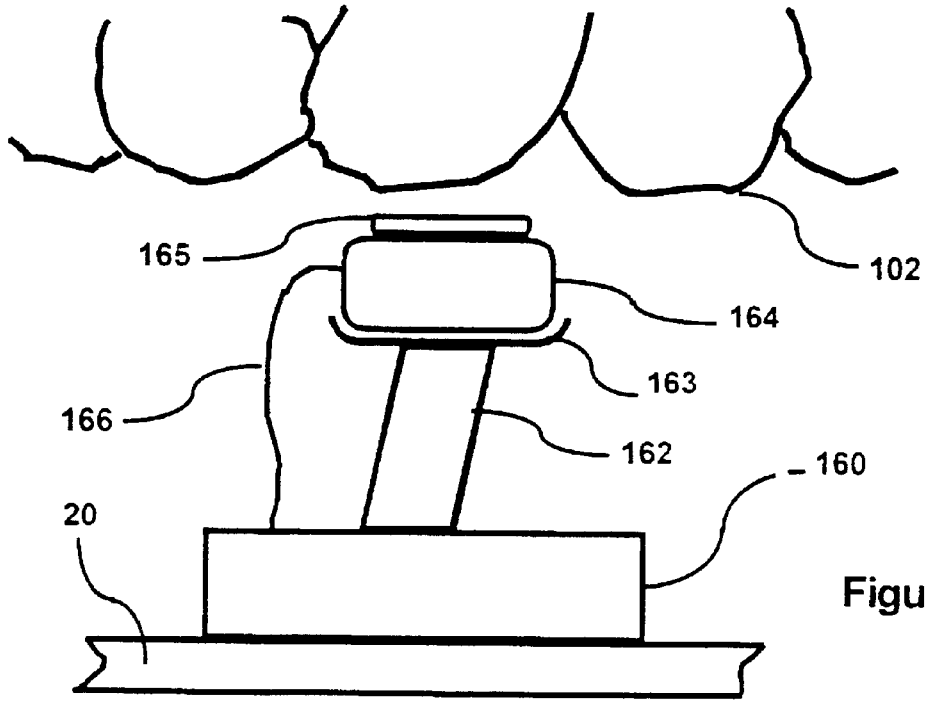
FIG. 6. A diagram of clearing mechanism using an explosive charge which is attached to the materials forming the hang-up.

The preferred embodiment of the present apparatus includes mechanisms for clearing the ore pass hang-up. In a particularly preferred embodiment, the mechanisms for clearing the hang-up comprises an emplacement unit that allows the placement and attachment of an explosive charge directly on the hang-up (i.e., on a portion or a particular boulder, stone, or similar fragment of the actual hang-up). The emplacement unit of FIG. 6 includes a drive unit 160 and a remotely controllable holder 162 with a proximal end and a distal end. The proximal end is pivotally and swivelably affixed to the drive unit 160, such that the drive unit is capable of causing the holder 162 to be pivotally raised or lowered, and to swivel. The distal end releasably holds the explosive charge 164. For example, as shown in FIG. 6, the explosive charge 164 rests by gravity on a curved holding container 163 at the distal end of holder 162. The explosive charge 164 further includes a detonation unit 166 such as, for example, a fuse wire ignitable from a remote location, or an electrical detonation wire closable by a remote switch, and an adhesive 165 capable of affixing the charge to the ore fragment in the hang-up. Of course, other methods of attaching the explosive charge to the hang-up can be used if desired. Such methods could include for example, grappling hooks or claws, plastic explosives which could be inserted into cracks or voids within the hang-up, and the use of the platform 20 with its immobilizing units to simply lock the platform and explosive charge in place below the hang-up. If the platform is used to mount and hold the explosive charge in places, an assembly wherein at least a portion of the assembly (especially the more expensive components) can be removed from the ore pass before detonation is preferred. Moreover, the use of such a platform to hold the explosive charge in place may, in some cases, be preferred since the platform can act as a reflector or barrier to direct the force of the explosion into the actual hang-up.

Figure 7:
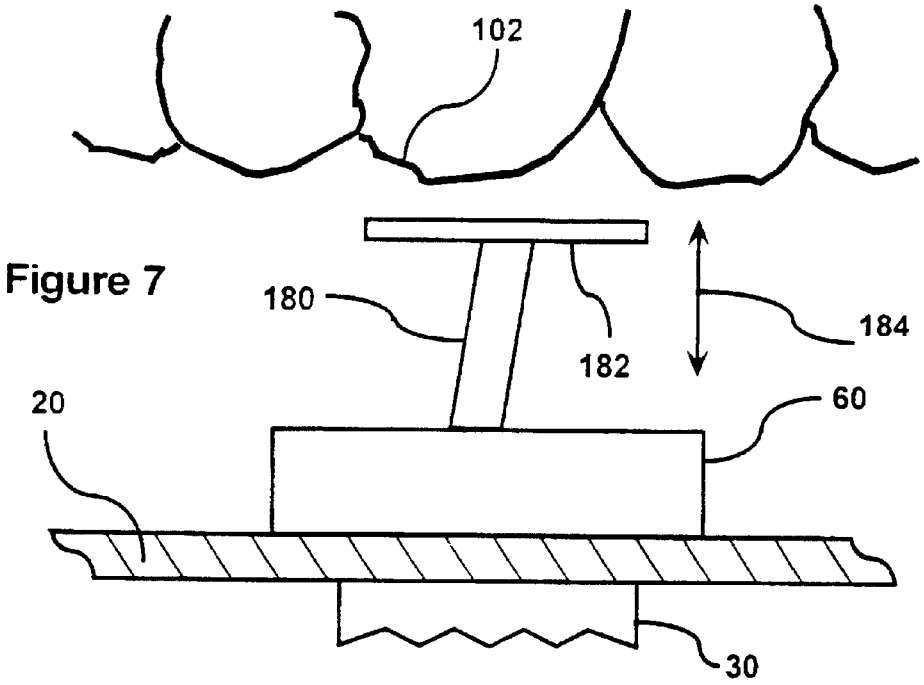
FIG. 7. A diagram of clearing mechanism of the present invention using a ram to strike or impact the materials forming the hang-up.

As shown in FIG. 7, the clearing mechanism 60 can also be designed to deliver mechanical blow or impact to the hang-up. For example, an hydraulically controlled ram 180 can be used to directly pound or strike the hang-up material; the general direction of the ram is illustrated by arrow 184. The ram could operate in fixed position (i.e., essentially in a single vertical direction) or could be pivotally mounted on the platform to allow more than one portion of the hang-up to be impacted. The ram 180 could also be fitted with a battering plate 182 (preferably of steel or similar material). If desired, the battering plate 182 could also have protrusions on its upper surfaces (i.e., cones, picks, or other shapes; not shown) which could allow the battering plate 182 to "grip" the materials within the hang-up during impact (i.e., to reduce the loss of force that would be expected if the battering plate were allowed to more easily slide off to the side during impact).

In general, the apparatus of the present invention is relatively easy to use. In operation, the apparatus is introduced into the lower end of an ore pass that is blocked by an ore pass hang-up. The apparatus is propelled upward along the ore pass while using images of the upward view of the ore pass for guidance. The operator, preferably at a remote location (i.e., out of danger in the event the hang-up is cleared), continually monitors the images transmitted by the imaging unit while controllably guiding the apparatus as it moves upward along the ore pass. Once the lower portion of the hang-up is located and the apparatus is moved into the desired position, the operator immobilizes the apparatus using controllable immobilizing units to engage the walls of the ore pass with sufficient force that the platform is held in place. In some cases, sufficient dust may be stirred up as the platform is moved into position to create visibility problems. In such cases, the platform may also be equipped with one or more upward directed water nozzles that can be remotely controlled by the operator wet down the ore pass for improved visibility.

Once in place, the clearing mechanism can be activated. In cases where the apparatus is to remain in place during the clearing operation, the clearing mechanism can be activated immediately. Where the apparatus, or portions of the apparatus, are to be removed prior to initiating the actual clearing operation, the clearing mechanism is, of course, only activated after the apparatus is removed from the ore pass. Removal of the apparatus, especially in cases where it is to be removed prior to the clearing operation, is essentially carried out using the same techniques and systems as used during the initial placement of the apparatus. In other words, once the apparatus is ready to be removed, the immobilizing units are disengaged from the walls and levitating units are activated to allow the apparatus to essentially "back out" of the ore pass. Of course, where the apparatus remains in place during the clearing operation, the weight of the freed hang-up material may essentially "flush" the apparatus out of the ore pass. In such cases, the apparatus may be damaged or destroyed. Of course, where such damage or destruction is expected, systems using relatively inexpensive components are preferred. Additionally, it may be preferred to use a separable apparatus (as discussed above) whereby the immobilizing units and the clearing mechanisms can be separated from the remainder of the apparatus; the remainder of the apparatus (preferably containing the most expensive components) can be removed prior to initiating the actual clearing operation. Generally, when using an explosive charge as the clearing mechanism, it is preferred that the charge is physically attached to the hang-up and that the apparatus is removed from the ore pass prior to activating the explosion.

As those skilled in the art will realize, the present system can be used in a number of systems to remotely and safely remove hang-ups from vertical or near-vertical shafts. Thus, although this invention was developed for use in underground mines, in can be used in a number of industries where solid materials must be moved from a higher to a lower level using vertical or near-vertical shafts or passageways and where the solid materials are prone to hanging up within the passageway. Such an apparatus would be especially useful in cases where the passageway is extensive along its longitudinal direction and/or the passageway is difficulty to access. In such cases, the clearing mechanisms to be used will preferably be non-damaging (i.e., not explosive charges). In cases where dust explosions are possible, a clearing mechanism employing an inert fluid under high pressure may be preferred in order to reduce the risk of such explosions. Likewise, in underground mines where dust explosions are possible, such a clearing mechanism may also be preferred.

We claim:

1. An apparatus for clearing a material hang-up in an essentially vertical shaft having walls which is used for moving material from a higher level to a lower level, said apparatus comprising:

(1) a platform having an upper surface and a lower surface and at least two ends, wherein the platform is movable along a longitudinal direction within the shaft;

(2) a remotely controllable propulsion unit affixed to the lower surface of the platform capable of propelling the platform along the longitudinal direction within the shaft and up to the hang-up;

(3) an imaging unit affixed to the upper surface of the platform capable of generating an image of an upward view within the shaft, wherein the image is transmittable to a remote viewer, and wherein the image can be viewed by an operator to assist in controlling and operating the apparatus:

(4) one or more extensible immobilizing units affixed to the ends of the platform, wherein the immobilizing units are remotely controllable, and wherein the immobilizing units, when activated by the operator, immobilize the platform within the shaft;

(5) a remotely controllable clearing unit affixed to the platform and adapted for clearing the hang-up within the shaft; and (6) a remote controller for controlling the propulsion unit, the immobilizing units, and the clearing unit;

wherein the apparatus can be controlled and operated by the operator using the remote controller at a safe distance from the shaft.

2. The apparatus as defined in claim 1, wherein the shaft is an ore pass in an underground mine.

3. The apparatus as described in claim 2, wherein the propulsion unit comprises a gas receiving chamber, a high pressure gas source in communication with the chamber, and at least one gas nozzle affixed to, and projecting downward from, the chamber.

4. The apparatus as described in claim 3, wherein the propulsion unit has at least three gas nozzles and wherein the gas nozzles are supersonic or converging-diverging type nozzles.

5. The apparatus as described in claim 2, wherein the imaging unit comprises a light source for directing light generally upward into the shaft above the platform and an imaging device for obtaining the image.

6. The apparatus as described in claim 2, wherein the apparatus has at least two extensible immobilizing units and wherein each extensible immobilizing unit comprises a balloon inflatable by pressurized gas and a first remotely controllable valve to allow the controlled inflation of the balloon by the operator, wherein the platform can be immobilized by contact of the inflatable balloons with the walls of the shaft.

7. The apparatus as described in claim 6, wherein each of the extensible immobilizing units further comprises a remotely controllable unit whereby the operator can deflate the balloons to allow the platform to be removed from, or repositioned within, the shaft.

8. The apparatus as described in claim 2, wherein the apparatus has at least two extensible immobilizing units and wherein each extensible immobilizing unit comprises a prong extendably engaged to a remotely controllable driving unit to allow extension of the prong by the operator, wherein the platform can be immobilized by contact of the extended prongs with the walls of the shaft.

9. The apparatus as described in claim 8, wherein each of the extensible immobilizing units further comprises a remotely controllable unit whereby the operator can retract the prongs to allow the platform to be removed from, or repositioned within, the shaft.

10. The apparatus as described in claim 2, wherein the clearing unit delivers high-impact blows to the hang-up.

11. The apparatus as described in claim 2, wherein the clearing unit delivers a stream of a high pressure fluid to the hang-up.

12. The apparatus as described in claim 2, wherein each of the extensible immobilizing units further comprises a remotely controllable unit whereby the operator can deactivate the immobilizing units to allow the platform to be removed from, or repositioned within, the shaft.

13. The apparatus as described in claim 2, wherein the clearing unit comprises an emplacement unit and an explosive charge, wherein the emplacement unit comprises (1) a remotely controllable drive unit and (2) a holder with a proximal end and a distal end, the proximal end pivotally and swivelably affixed to the drive unit, the distal end releasably holding the explosive charge, wherein the drive unit is capable of causing the holder to be pivotally raised or lowered, and to swivel; and wherein the explosive charge further includes (1) a detonation unit and (2) an attachment unit for attaching the explosive charge to the hang-up.

14. The apparatus as described in claim 13, wherein each of the extensible immobilizing units further comprises a remotely controllable unit whereby the operator can deactivate the immobilizing units to allow the platform to be removed from the shaft prior to activation of the explosive charge.

15. The apparatus as described in claim 13, wherein the attachment unit is an adhesive.

16. A method for clearing a material hang-up in an essentially vertical shaft having walls which is used for moving material from a higher level to a lower level, said method comprising:

(1) introducing an apparatus for clearing the hang-up into the lower end of the shaft blocked by the hang-up, wherein the apparatus is capable of:

(a) being remotely propelled within the shaft so that the apparatus can be positioned adjacent to and below the hang-up by an operator located at a safe distance from the lower end of the shaft, (b) providing an image of an upward view of the shaft as the apparatus is propelled within the shaft and is positioned adjacent to and below the hang-up, where the image is transmitted to the operator, (c) being remotely immobilized in a position adjacent to and below the hang-up by the operator, the apparatus comprising one or more remotely controllable extensible immobilizing units, which, when activated, immobilize the apparatus within the shaft, and (d) remotely clearing the hang-up after being immobilized in a position adjacent to and below the hang-up;

(2) remotely propelling the apparatus upward within the shaft until the apparatus is positioned adjacent to and below the hang-up, wherein the image is used by the operator to guide the apparatus within the shaft;

(3) remotely immobilizing the apparatus adjacent to and below the hang-up; and (4) remotely clearing the hang-up.

17. The method as described in claim 16, wherein the apparatus comprises:

(1) a platform having an upper surface and a lower surface and at least two ends, wherein the platform is movable along a longitudinal direction within the shaft;

(2) a remotely controllable propulsion unit affixed to the lower surface of the platform capable of propelling the platform along the longitudinal direction within the shaft and up to the hang-up;

(3) an imaging unit affixed to the upper surface of the platform capable of generating an image of an upward view within the shaft, wherein the image is transmittable to a remote viewer, and wherein the image can be viewed by an operator to assist in controlling and operating the apparatus;

(4) The one or more extensible immobilizing units, being affixed to the ends of the platform;

(5) a remotely controllable clearing unit affixed to the platform and adapted for clearing the hang-up within the shaft; and (6) a remote controller for controlling the propulsion unit, the immobilizing units, and the clearing unit;

wherein the apparatus can be controlled and operated by the operator using the remote controller at a safe distance from the shaft.

18. The method as described in claim 17, wherein the shaft is an ore pass in an underground mine.

19. The method as described in claim 18, wherein the propulsion unit comprises a gas receiving chamber, a high pressure gas source in communication with the chamber, and at least one gas nozzle affixed to, and projecting downward from, the chamber.

20. The method as described in claim 19, wherein the imaging unit comprises a light source for directing light generally upward into the shaft above the platform and an imaging device for obtaining the image.

21. The method as described in claim 20, wherein the light source and the imaging device are remotely controlled.

22. The method as described in claim 20, wherein the apparatus has at least two extensible immobilizing units and wherein each extensible immobilizing unit comprises a balloon inflatable by pressurized gas and a first remotely controllable valve to allow the controlled inflation of the balloon by the operator, wherein the platform can be immobilized by contact of the inflatable balloons with the walls of the shaft.

23. The method as described in claim 22, wherein the hang-up is cleared by delivering high-impact blows to the hang-up from the clearing unit.

24. The method as described in claim 22, wherein the hang-up is cleared by directing a stream of a high pressure fluid onto the hang-up from the clearing unit.

25. The method as described in claim 22, wherein each of the extensible immobilizing units further comprises a remotely controllable unit whereby the operator can deactivate the immobilizing units to allow the platform to be removed from, or repositioned within, the shaft.

26. The method as described in claim 25, wherein each of the extensible immobilizing units further comprises a remotely controllable unit whereby the operator can deflate the balloons to allow the platform to be removed from, or repositioned within, the shaft.

27. The method as described in claim 22, wherein the clearing unit comprises an emplacement unit and an explosive charge, wherein the emplacement unit comprises (1) a remotely controllable drive unit and (2) a holder with a proximal end and a distal end, the proximal end pivotally and swivelably affixed to the drive unit, the distal end releasably holding the explosive charge, wherein the drive unit is capable of causing the holder to be pivotally raised or lowered, and to swivel; and wherein the explosive charge further includes (1) a detonation unit and (2) an attachment unit for attaching the explosive charge to the hang-up.

28. The method as described in claim 27, wherein each of the extensible immobilizing units further comprises a remotely controllable unit whereby the operator can deactivate the immobilizing units to allow the platform to be removed from the shaft prior to activation of the explosive charge.

29. The method as described in claim 28, wherein the attachment unit is an adhesive.

30. The method as described in claim 20, wherein the apparatus has at least two extensible immobilizing units and wherein each extensible immobilizing unit comprises a prong extendably engaged to a remotely controllable driving unit to allow extension of the prong by the operator, wherein the platform can be immobilized by contact of the extended prongs with the walls of the shaft.

31. The method as described in claim 30, wherein the hang-up is cleared by delivering high-impact blows to the hang-up from the clearing unit.

32. The method as described in claim 30, wherein the hang-up is cleared by directing a stream of a high pressure fluid onto the hang-up from the clearing unit.

33. The method as described in claim 30, wherein each of the extensible immobilizing units further comprises a remotely controllable unit whereby the operator can deactivate the immobilizing units to allow the platform to be removed from, or repositioned within, the shaft.

34. The method as described in claim 33, wherein each of the extensible immobilizing units further comprises a remotely controllable unit whereby the operator can retract the prongs to allow the platform to be removed from, or repositioned within, the shaft.

35. The method as described in claim 30, wherein the clearing unit comprises an emplacement unit and an explosive charge, wherein the emplacement unit comprises (1) a remotely controllable drive unit and (2) a holder with a proximal end and a distal end, the proximal end pivotally and swivelably affixed to the drive unit, the distal end releasably holding the explosive charge, wherein the drive unit is capable of causing the holder to be pivotally raised or lowered, and to swivel; and wherein the explosive charge further includes (1) a detonation unit and (2) an attachment unit for attaching the explosive charge to the hang-up.

36. The method as described in claim 25, wherein each of the extensible immobilizing units further comprises a remotely controllable unit whereby the operator can deactivate the immobilizing units to allow the platform to be removed from the shaft prior to activation of the explosive charge.

37. The method as described in claim 36, wherein the attachment unit is an adhesive.

38. The method as described in claim 20, wherein the propulsion unit has at least three gas nozzles and wherein the gas nozzles are supersonic or converging-diverging type nozzles.

39. The method as described in claim 19, wherein the propulsion unit has at least three gas nozzles and wherein the gas nozzles are supersonic or converging-diverging type nozzles.

* * * * *

UNITED STATES PATENT AND TRADEMARK OFFICE

CERTIFICATE OF CORRECTION

PATENT NO. : 6,672,673 B1
APPLICATION NO. : 10/089432
DATED : January 6, 2004
INVENTOR(S) : Miller et al.

It is certified that error appears in the above-identified patent and that said Letters Patent is hereby corrected as shown below:

On the Front Cover:

In the abstract, line 8, "trough" should be --through--.

In the Assignee: "The United States of America as represented by the Department of Health and Human Services, Washington, DC (US)" should be --The United States of America as represented by the Department of Health and Human Services, Centers for Disease Control and Prevention, Atlanta, GA (US)--.

In column 1, line 67 "case," should be --cases,--.

In column 2, line 1 "rarely in" should be --rarely; in--.

In column 3, line 14 "needs for method" should be --a need for a method--.

In column 6, line 44-45 "may having" should be --may have--.

In column 7, line 48 "pass The" should be --pass. The--.

In column 9, line 7 "1B. 1C," should be --1B, 1C--.

In column 10, line 13 "disengaged" should be --disengage--.

In column 10, line 55 "an hydraulically" should be --a hydraulically--.

In column 11, line 21 "operator wet" should be --operator to wet--.

UNITED STATES PATENT AND TRADEMARK OFFICE

CERTIFICATE OF CORRECTION

PATENT NO. : 6,672,673 B1
APPLICATION NO. : 10/089432
DATED : January 6, 2004
INVENTOR(S) : Miller et al.

It is certified that error appears in the above-identified patent and that said Letters Patent is hereby corrected as shown below:

In column 14, line 17 "(4) The" should be --(4) the--.

In column 14, line 17 "units, being" should be --units being--.

In column 16, line 17 "claim 25," should be --claim 35,--.

Signed and Sealed this

Twenty-fourth Day of October, 2006

JON W. DUDAS
*Director of the United States Patent and Trademark Office*